US008851654B2

(12) United States Patent
Shimada et al.

(10) Patent No.: US 8,851,654 B2
(45) Date of Patent: Oct. 7, 2014

(54) IMAGE FORMING APPARATUS AND IMAGE FORMING METHOD

(75) Inventors: Yoshitaka Shimada, Matsumoto (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 177 days.

(21) Appl. No.: 13/456,483

(22) Filed: Apr. 26, 2012

(65) Prior Publication Data

US 2012/0287188 A1 Nov. 15, 2012

(30) Foreign Application Priority Data

May 12, 2011 (JP) ..... 2011-107462

(51) Int. Cl.

| | |
|---|---|
| ***B41J 2/01*** | (2006.01) |
| ***B41J 2/175*** | (2006.01) |
| ***B41J 29/38*** | (2006.01) |
| ***B41J 2/21*** | (2006.01) |
| ***B41J 3/54*** | (2006.01) |

(52) U.S. Cl.

CPC ..... *B41J 2/2117* (2013.01); *B41J 3/543* (2013.01)

USPC ..... 347/102; 347/101; 347/85; 347/9; 347/12

(58) Field of Classification Search

USPC ..... 347/12, 66, 85, 9, 101, 102

See application file for complete search history.

(56) References Cited

U.S. PATENT DOCUMENTS

| | | | | |
|---|---|---|---|---|
| 6,822,759 | B1 * | 11/2004 | Ono et al. | 358/1.9 |
| 7,244,021 | B2 | 7/2007 | Arai | |
| 7,407,277 | B2 * | 8/2008 | Yoneyama | 347/102 |
| 2001/0028374 | A1 * | 10/2001 | Ogawa et al. | 347/35 |
| 2007/0279470 | A1 | 12/2007 | Arai | |
| 2010/0194838 | A1 * | 8/2010 | Mitsuzawa | 347/102 |

FOREIGN PATENT DOCUMENTS

| | | | |
|---|---|---|---|
| JP | 2002-38063 | | 6/2002 |
| JP | 2003237100 | A * | 8/2003 |
| JP | 2004-306591 | | 4/2004 |

* cited by examiner

*Primary Examiner* — Sarah Al Hashimi

(74) *Attorney, Agent, or Firm* — Workman Nydegger

(57) ABSTRACT

An image forming apparatus provided with a first mode in which one nozzle row group is positioned so as to be shifted to the downstream side of the medium transport direction with respect to another nozzle row group, ink forming a main image is filled into the first nozzle row in the one nozzle row group, ink forming a background image is filled into the second nozzle row in the other nozzle row group, and the one nozzle row group and the other nozzle row group are used to form the background image before the main image, and a second mode, in which ink forming a background image is filled into the first nozzle row, ink forming the main image is filled into the second nozzle row, and the one nozzle row group and the other nozzle row group are used to form the main image before the background image.

6 Claims, 6 Drawing Sheets

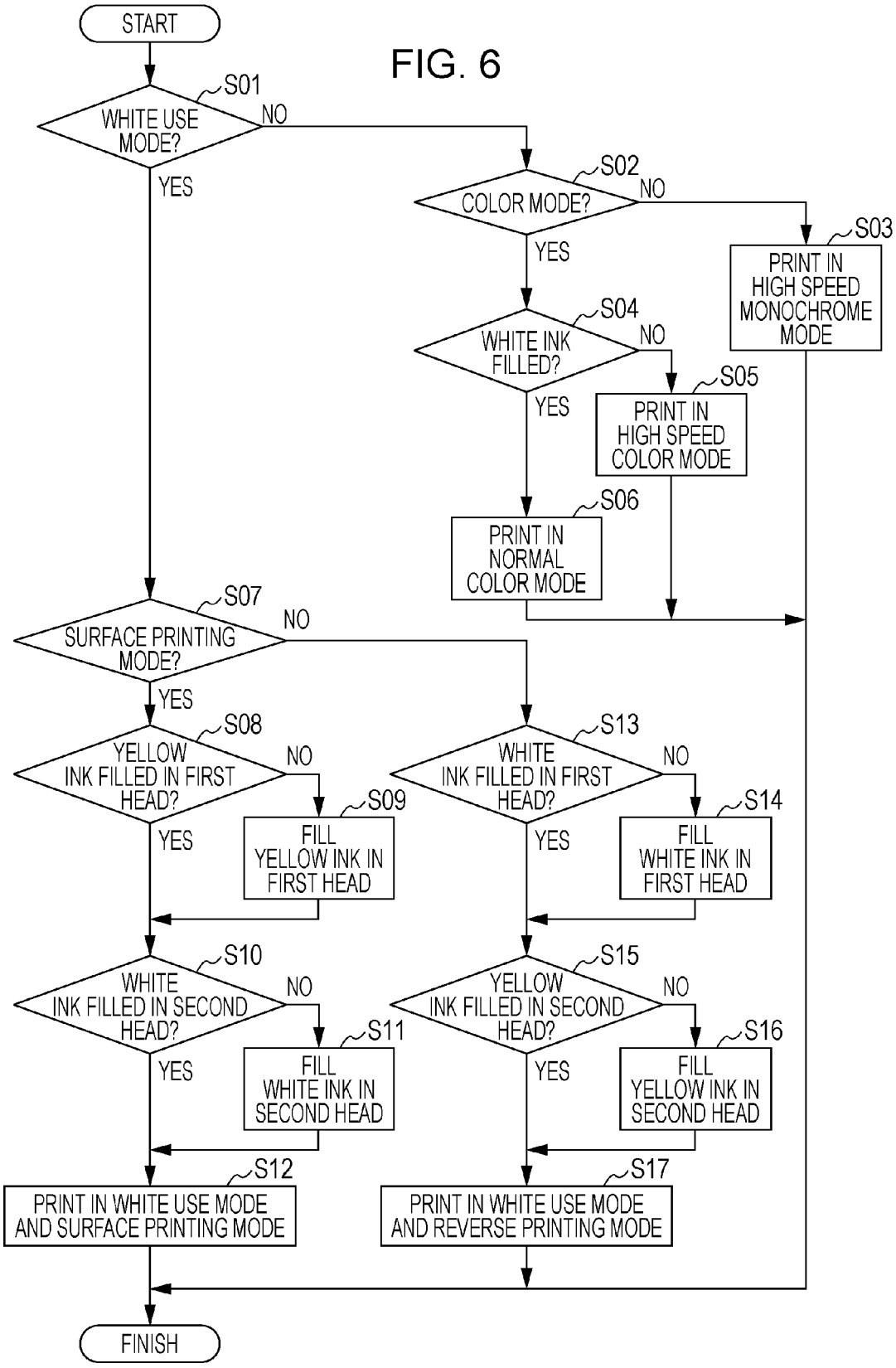
FIG. 6
START
S01
WHITE USE MODE?
NO
YES
S02
COLOR MODE?
NO
YES
S03
PRINT IN HIGH SPEED MONOCHROME MODE
S04
WHITE INK FILLED?
NO
YES
S05
PRINT IN HIGH SPEED COLOR MODE
S06
PRINT IN NORMAL COLOR MODE
S07
SURFACE PRINTING MODE?
NO
YES
S08
YELLOW INK FILLED IN FIRST HEAD?
NO
YES
S09
FILL YELLOW INK IN FIRST HEAD
S13
WHITE INK FILLED IN FIRST HEAD?
NO
YES
S14
FILL WHITE INK IN FIRST HEAD
S10
WHITE INK FILLED IN SECOND HEAD?
NO
YES
S11
FILL WHITE INK IN SECOND HEAD
S15
YELLOW INK FILLED IN SECOND HEAD?
NO
YES
S16
FILL YELLOW INK IN SECOND HEAD
S12
PRINT IN WHITE USE MODE AND SURFACE PRINTING MODE
S17
PRINT IN WHITE USE MODE AND REVERSE PRINTING MODE
FINISH

IMAGE FORMING APPARATUS AND IMAGE FORMING METHOD

BACKGROUND

The entire disclosure of Japanese Patent Application No: 2011-107462, filed May 12, 2011, is expressly incorporated by reference herein in its entirety.

1. Technical Field

The present invention relates to an image forming apparatus and an image forming method.

2. Related Art

Among printers which are image forming apparatuses, there are printers repeating an ejection operation ejecting ink while a head moves in a moving direction and a transport operation transporting a medium in a transport direction intersecting the moving direction. Further, print apparatuses performing printing using white ink in addition to color inks such as cyan, magenta or yellow are widespread (for example, refer to JP-A-2002-38063). In such printers, for example, it is possible to print a white background image overlapped on a main image using color inks and it is possible to print a color image with excellent color without being affected by the ground color of the medium.

However, in order to print an image with the background image superimposed on the main image, when nozzle rows for ejecting ink for printing the background image (for example, white ink) are separately provided in addition to nozzle rows ejecting ink for printing the main image (for example, color inks such as cyan, magenta, and yellow), the number of nozzle rows provided in the printer is increased, which is not preferable.

SUMMARY

Thus, an advantage of some aspects of the invention is to reduce the number of nozzle rows.

According to an aspect of the invention, there is provided an image forming apparatus including: a plurality of nozzle row groups in which one nozzle row group is positioned shifted to one side in a predetermined direction with respect to another nozzle row group, the plurality of nozzle rows extends in a direction intersecting the predetermined direction in each of the nozzle row groups, a plurality of nozzles ejecting ink is lined up in the predetermined direction in each of the nozzle rows, and the plurality of nozzles is communicated with a common ink chamber; and a control unit repeatedly performing an ejection operation ejecting the ink from the nozzles while relatively moving the plurality of nozzle row groups and the medium in the intersecting direction and a transport operation moving the relative position of the medium with respect to the plurality of nozzle row groups to one side in the predetermined direction, in which the image forming apparatus is provided with a first mode, in which ink forming a main image is filled into the common ink chamber communicating with the plurality of nozzles belonging to the first nozzle row in the one nozzle row group, ink forming a background image of the main image is filled into the common ink chamber communicating with the plurality of nozzles belonging to the second nozzle row in the other nozzle row group, and the one nozzle row group and the other nozzle row group are used to form the background image before the main image with respect to a predetermined region of the medium, and a second mode, in which ink forming the background image is filled into the common ink chamber communicating with the plurality of nozzles belonging to the first nozzle row, ink forming the main image is filled into the common ink chamber communicating with the plurality of nozzles belonging to the second nozzle row, and the one nozzle row group and the other nozzle row group are used to form the main image before the background image with respect to a predetermined region of the medium.

BRIEF DESCRIPTION OF THE DRAWINGS

The invention will be described with reference to the accompanying drawings, wherein like numbers reference like elements.

FIG. 6 is a flow illustrating the printing flow.

DESCRIPTION OF EXEMPLARY EMBODIMENTS

Figure 1A:
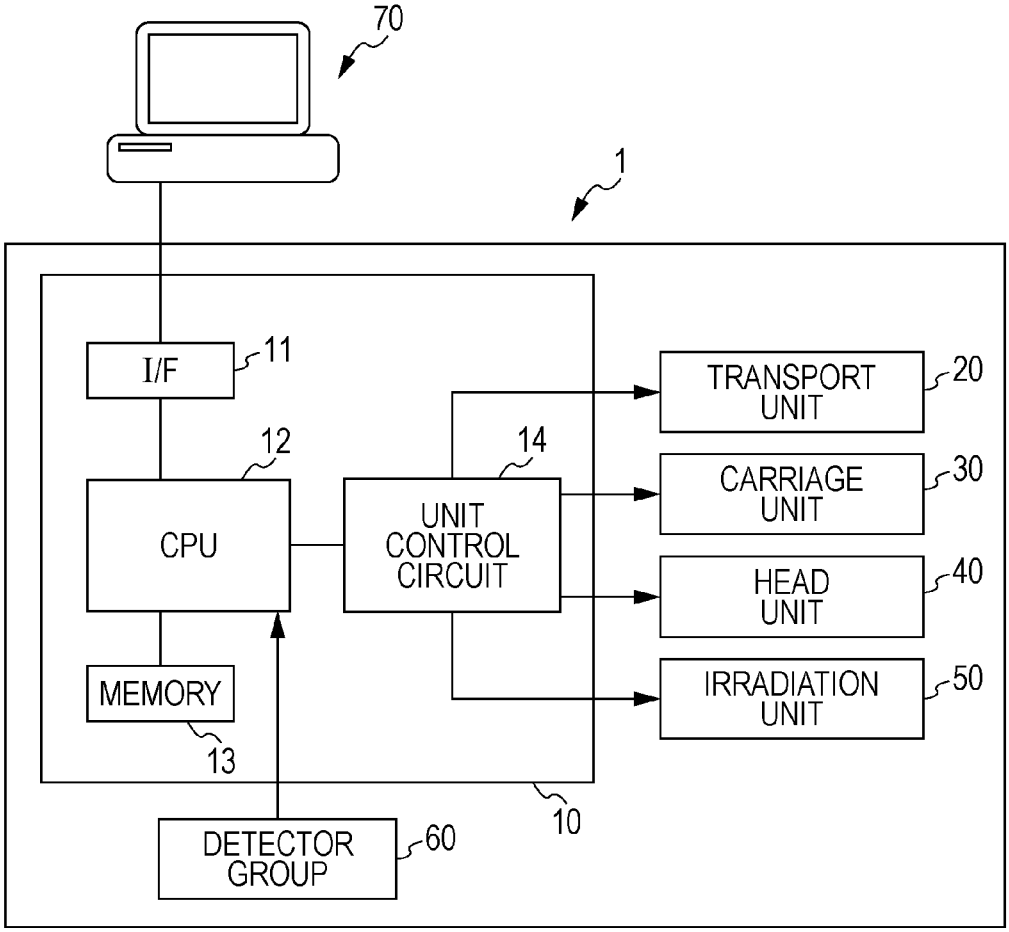
FIG. 1A is a configuration block diagram of an entire printer and FIG. 1B is a schematic perspective view of the printer.

At least the following will be made clear by the description of the specification and the accompanying drawings.

In other words, there is provided an image forming apparatus including: a plurality of nozzle row groups in which one nozzle row group is positioned shifted to one side in a predetermined direction with respect to another nozzle row group, the plurality of nozzle rows extends in a direction intersecting the predetermined direction in each of the nozzle row groups, a plurality of nozzles ejecting ink is lined up in the predetermined direction in each of the nozzle rows, and the plurality of nozzles is communicated with a common ink chamber; and a control unit repeatedly performing an ejection operation ejecting the ink from the nozzles while relatively moving the plurality of nozzle row groups and the medium in the intersecting direction and a transport operation moving the relative position of the medium with respect to the plurality of nozzle row groups to one side in the predetermined direction, in which the image forming apparatus is provided with a first mode, in which ink forming a main image is filled into the common ink chamber communicating with the plurality of nozzles belonging to the first nozzle row in the one nozzle row group, ink forming a background image of the main image is filled into the common ink chamber communicating with the plurality of nozzles belonging to the second nozzle row in the other nozzle row group, and the one nozzle row group and the other nozzle row group are used to form the background image before the main image with respect to a predetermined region of the medium, and a second mode, in which ink forming the background image is filled into the common ink chamber communicating with the plurality of nozzles belonging to the first nozzle row, ink forming the main image is filled into the common ink chamber communicating with the plurality of nozzles belonging to the second nozzle row, and the one nozzle row group and the other nozzle row group are used to form the main image before the background image with respect to a predetermined region of the medium.

According to the image forming apparatus, it is possible to reduce the number of nozzle rows.

In the image forming apparatus, the one nozzle row group and the other nozzle row group are respectively capable of ejecting the same color inks of a plurality of colors as the ink forming the main image, and the color of the ink forming the main image ejected from the first nozzle row and the color of the ink forming the main image ejected from the second nozzle row are the same.

According to such an image forming apparatus, it is possible to increase the colors of the image which may be rapidly formed using the one nozzle row group and the other nozzle row group.

The image forming apparatus is provided with a third mode in which the color of the ink forming the main image respectively ejected from the first nozzle row and the second nozzle row is a color other than black, and the nozzle row ejecting black ink in the one nozzle row group and the nozzle row ejecting black ink in the other nozzle row group are used to form the main image, which is a monochrome image, on the medium without forming the background image.

According to such an image forming apparatus, it is possible to rapidly form a monochrome image using the one nozzle row group and the other nozzle row group.

The image forming apparatus is provided with a fourth mode, in which, when ink forming the background image is not filled in both of the common ink chamber communicated with the plurality of nozzles belonging to the first nozzle row and the common ink chamber communicated with the plurality of nozzles belonging to the second nozzle row, the one nozzle row group and the other nozzle row group are used, and, when the ink forming the background image is filled in one of the common ink chamber communicated with the plurality of nozzles belonging to the first nozzle row and the common ink chamber communicated with the plurality of nozzles belonging to the second nozzle row, the nozzle row group having the nozzle row for which the common ink chamber is filled with the ink forming the main image among the first nozzle row and the second nozzle row is used, whereby the main image, which is a color image, is formed on the medium without forming the background image.

According to such an image forming apparatus, it is possible to prevent delaying of the image forming start time and to suppress the consumption of ink for purposes other than image forming while forming a color image as rapidly as possible.

In addition, there is provided an image forming method provided with an image forming apparatus including: a plurality of nozzle row groups in which one nozzle row group is positioned shifted to one side in a predetermined direction with respect to another nozzle row group, the plurality of nozzle rows extends in a direction intersecting the predetermined direction in each of the nozzle row groups, a plurality of nozzles ejecting ink is lined up in the predetermined direction in each of the nozzle rows, and the plurality of nozzles is communicated with a common ink chamber; and a control unit repeatedly performing an ejection operation ejecting the ink from the nozzles while relatively moving the plurality of nozzle row groups and the medium in intersecting directions and a transport operation moving the relative position of the medium with respect to the plurality of nozzle row groups to one side in the predetermined direction, in which, when the background image is formed before the main image with respect to a predetermined region of the medium, ink forming the main image is filled into the common ink chamber communicating with the plurality of nozzles belonging to the first nozzle row in the one nozzle row group, ink forming a background image of the main image is filled into the common ink chamber communicating with the plurality of nozzles belonging to the second nozzle row in the other nozzle row group, and the one nozzle row group and the other nozzle row group are used to form an image on the medium, and when the main image is formed before the background image with respect to a predetermined region of the medium, ink forming the background image is filled into the common ink chamber communicating with the plurality of nozzles belonging to the first nozzle row, ink forming the main image is filled into the common ink chamber communicating with the plurality of nozzles belonging to the second nozzle row, and the one nozzle row group and the other nozzle row group are used to form an image on the medium.

According to the image forming method, it is possible to form the main image and the background image so as to overlap while reducing the number of nozzle rows.

Printing System

Description will be given of the embodiments, wherein an example will be given of a print system in which an ink jet printer (below, printer) is set as the image forming apparatus and the printer is connected with a computer.

Figure 1B:
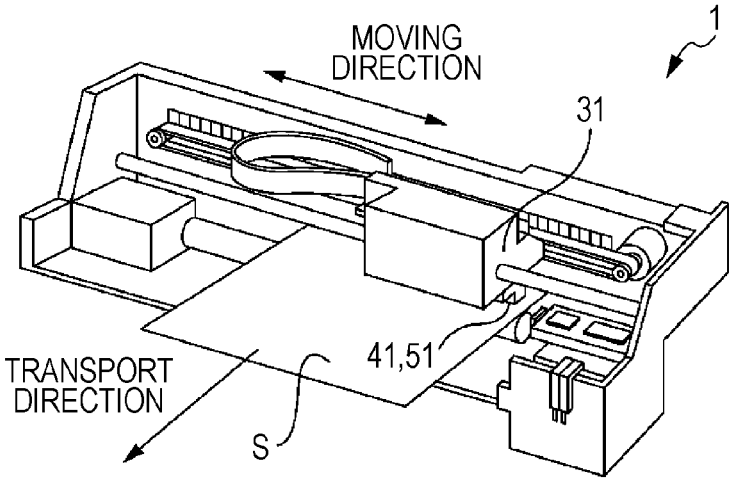
Figure 2:
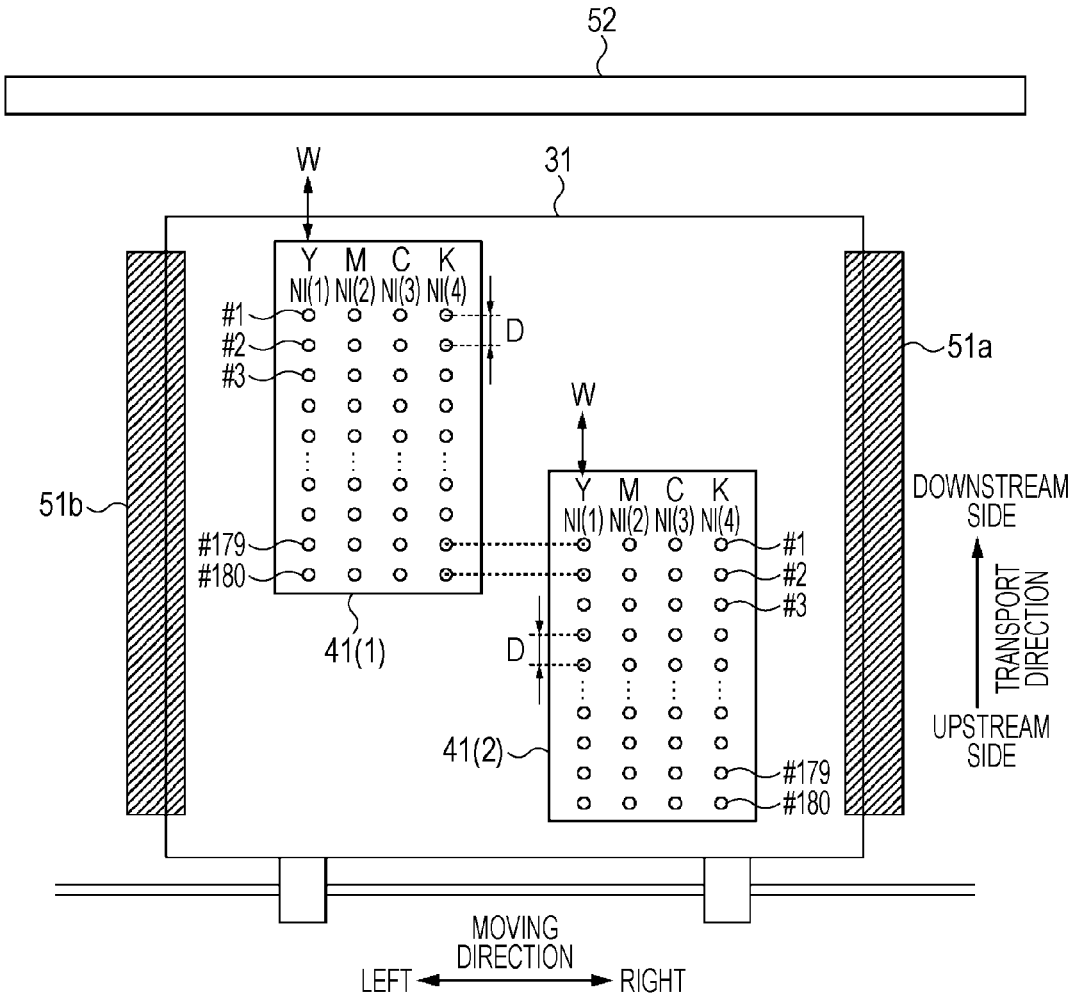
FIG. 2 is a diagram illustrating the periphery of a carriage.

FIG. 1A is a configuration block diagram of an entire printer 1, FIG. 1B is a schematic perspective view of the printer 1, and FIG. 2 is a diagram illustrating the periphery of a carriage 31. In addition, in FIG. 2, a nozzle array is virtually shown from above the head 41.

The printer 1 of the present embodiment forms an image on a medium S (for example, paper, cloth, or film) by ejecting ultraviolet curable ink cured by the irradiation of ultraviolet light. In addition, the ultraviolet curable ink (below, UV ink) is an ink including an ultraviolet curable resin and is cured by the occurrence of a light polymerization reaction in the ultraviolet curable resin when ultraviolet light is irradiated thereon.

A computer 70 is communicably connected with the printer 1 and outputs print data created using a printer driver to the printer 1.

A controller 10 is a control unit that performs control of the printer 1. An interface unit 11 is for sending and receiving data between the computer 70 and printer 1. A CPU 12 is an arithmetic processing unit that performs overall control of the printer 1. A memory 13 is for securing a region storing programs of the CPU 12 or an operation region. The CPU 12 controls each unit using a unit control circuit 14. In addition, a detector group 60 monitors the conditions in the printer 1 and the controller 10 controls each unit based on the detection result thereof.

The transport unit 20 is for feeding the medium S to a printable position and transporting the medium S by a predetermined transport amount in the transport direction during printing.

The carriage unit 30 is for moving a head 41 and the like mounted on a carriage 31 in a movement direction intersecting the transport direction.

The head unit 40 is for ejecting ink to the medium S and, as shown in FIG. 2, includes two heads 41 (a first head 41 (1) and second head 41 (2)). Four nozzle rows Nl, in which a plurality of nozzles ejecting ink is lined up at predetermined intervals (nozzle pitch D) in the transport direction, are each formed on the lower surface of the head 41, and the four nozzle rows Nl are lined up in the moving direction. For illustrative purposes, in order from the nozzle row Nl of the left side of the moving direction, the nozzle rows Nl are referred to as first nozzle row Nl (1), second nozzle row Nl (2), third nozzle row Nl (3), and fourth nozzle row Nl (4), and, among the nozzles belonging to each nozzle row Nl, numbers (#1, #2, . . . #180) are given in order of small to large from the nozzles of the transport direction downstream side.

Each head 41 is set to be capable of ejecting five colors of ink (CMYK and W); the first nozzle row Nl (1) is set to be capable of selectively ejecting yellow ink (Y) or white ink (W), the second nozzle row Nl (2) is set to be capable of ejecting magenta ink (M), the third nozzle row Nl (3) is set to be capable of ejecting cyan ink (C), and the fourth nozzle row Nl (4) is set to be capable of ejecting black ink (K).

Further, the first head 41 (1) (corresponding to the one nozzle row group) is shifted to the left side of the moving direction with respect to the second head 41 (2) (corresponding to the other nozzle row group) and positioned so as to be shifted to the downstream side of the transport direction (corresponding to one side in the predetermined direction). In addition, the end portion of the transport direction upstream side of the first head 41 (1) and the end portion of the transport direction downstream side of the second head 41 (2) overlap. Here, the transport direction positions of the two end portion nozzles (#179 and #180) of the transport direction upstream side of the first head 41 (1) and the two end portion nozzles (#1 and #2) of the transport direction downstream side of the second head 41 (2) are set to be equal. Therefore, in a state where the first head 41 (1) and the second head 41 (2) are aligned, the plurality of nozzles is lined up in the transport direction at intervals of the nozzle pitch D.

In this manner, by overlapping the end portions of the transport direction of the first head 41 (1) and the second head 41 (2), it is possible to make the join between the image part formed by the first head 41 (1) and the image part formed by the second head 41 (2) inconspicuous, and it is possible to improve the image quality. However, without being limited thereto, the end portions of the transport direction of the first head 41 (1) and the second head 41 (2) may not be overlapped. For example, with respect to the nozzle #180 positioned at the most upstream side in the transport direction of the first head 41 (1), the nozzle #1 positioned at the most downstream side in the transport direction of the second head 41 (2) may be set to be positioned at the transport direction upstream side by only the nozzle pitch D.

The irradiation unit 50 is for irradiating ultraviolet light to the UV ink landed on the medium S and curing the UV ink, and includes a provisional irradiation unit 51 and a main irradiation unit 52. In addition, as a light source of ultraviolet light irradiation, for example, light-emitting diodes (LED), metal halide lamps, mercury lamps, and the like may be exemplified.

As shown in FIG. 2, the provisional irradiation units 51*a* and 51*b* are provided on both end portions in the moving direction of the carriage 31 and move in the moving direction with the two heads 41 along with the movement of the carriage 31. In addition, the provisional irradiation units 51*a* and 51*b* extend in the transport direction in the same manner as the nozzle rows provided at the head 41. Thus, the UV ink ejected from the two heads 41 during the movement in the moving direction is irradiated with ultraviolet light by the provisional irradiation units 51*a* and 51*b* as soon as the ink lands on the medium S.

The main irradiation unit 52 is provided so as to be fixed at the downstream side of the transport direction in relation to the carriage 31. The length of the moving direction of the main irradiation unit 52 is the length of the moving direction of the medium S or more and the main irradiation unit 52 irradiates ultraviolet light to the UV ink on the medium S passing below. Thus, the UV ink on the medium S is completely cured by the main irradiation unit 52.

In the printer 1, the controller 10 (corresponding to the control unit) repeatedly performs an ejection operation ejecting ink from a nozzle while two heads 41 (corresponding to a plurality of nozzle row groups) and the provisional irradiation units 51*a* and 51*b* move in a moving direction (direction intersecting the predetermined direction) with respect to a medium and a transport operation transporting the medium to the transport direction downstream side with respect to the two heads 41. As a result, dots are formed in a subsequent ejection operation at a position on the medium S different to the position of dots formed by a previous ejection operation, whereby a two-dimensional image is printed on the medium S (an image is formed). Below, one ejection operation will be referred to as a "pass".

Method of Switching Ink

Figure 3A:
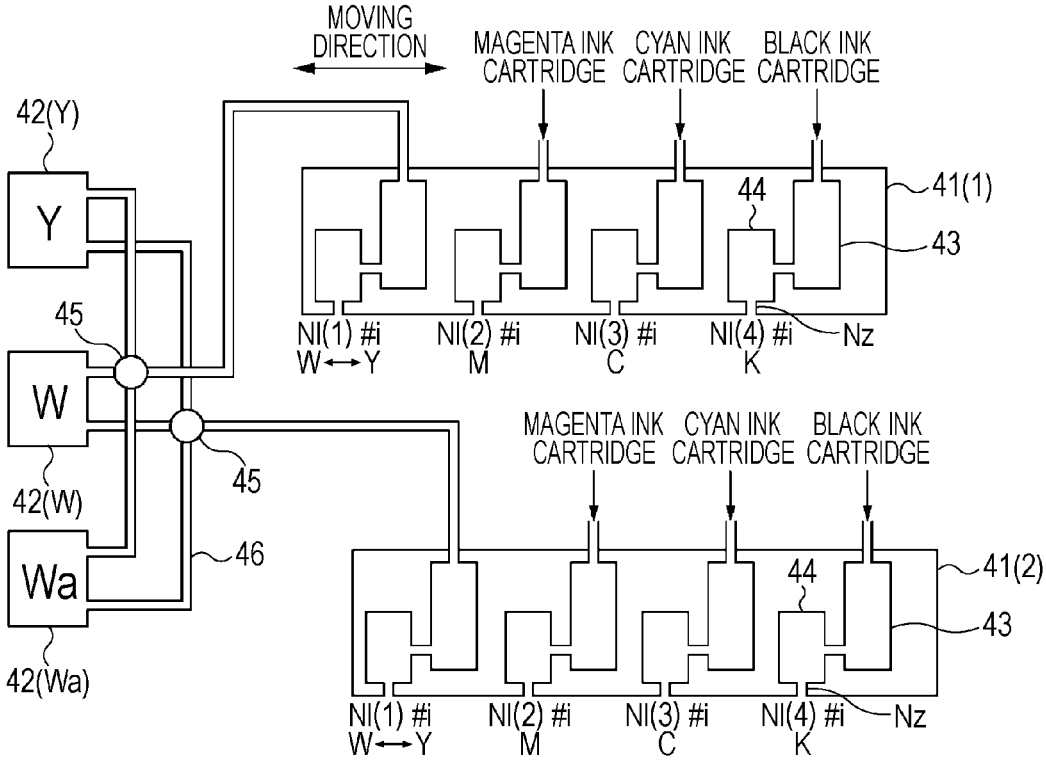
FIG. 3A and FIG. 3B are diagrams illustrating the method of switching the ink.
Figure 3B:
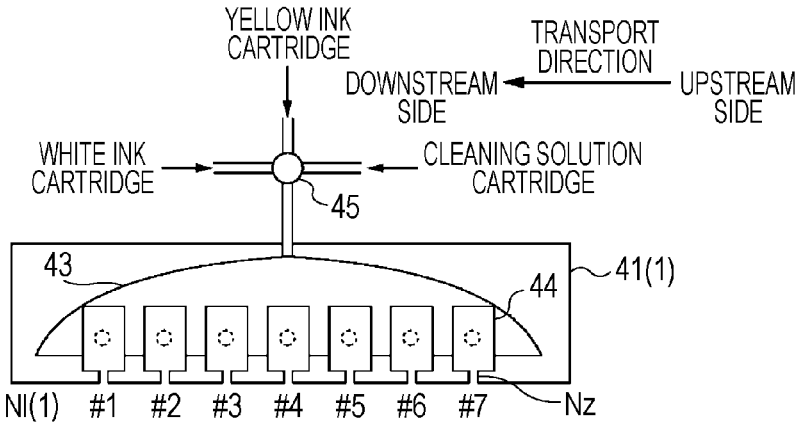

FIG. 3A and FIG. 3B are diagrams illustrating the method of switching the ink. FIG. 3A is a cross-sectional view of the two heads 41 (1) and 41 (2) seen from the transport direction and schematically shows flow channels of ink supplied to the first nozzle row Nl (1). FIG. 3B is a cross-sectional view of the first nozzle row Nl (1) and the first head 41 (1) seen from the moving direction. Here, in FIG. 3B, the number of nozzles belonging to the first nozzle row Nl (1) is reduced to seven.

Each of the heads 41 (1) and 41 (2) includes a "nozzle row group" in which four nozzle rows Nl (1) to (4) are lined up in the moving direction, and a "common ink chamber 43" storing ink supplied to the head 41 from the ink cartridge 42 (ink supply source) is provided for each nozzle row Nl. Furthermore, a "pressure chamber 44" positioned between the common ink chamber 43 and the nozzles Nz and communicating with the common ink chamber 43 and the nozzles Nz is provided for each nozzle Nz. Thus, a plurality of nozzles (#1 to #180) belonging to a certain nozzle row is communicated with the same common ink chamber 43 and the ink filled in the common ink chamber 43 is ejected from the plurality of nozzles belonging to the nozzle row. In other words, nozzles belonging to different nozzle rows are communicated with different common ink chambers 43 without being communicated with each other.

Here, the ink ejection system from the nozzles Nz may be a piezo system ejecting ink from the nozzles Nz by expanding and contracting the pressure chamber 44 by applying a voltage to a driving element (piezo element) corresponding to each nozzle Nz, or may be a thermal system using bubbles to eject ink from the nozzles Nz by generating the bubbles in the nozzles Nz using a heat generating element.

In addition, as described above, among the four nozzle rows Nl (1) to Nl (4) included in each of the head 41 (1) and head 41 (2), the second nozzle row Nl (2) is set to be capable of ejecting magenta ink. Therefore, the common ink chamber 43 corresponding to the second nozzle row Nl (2) is communicated with a magenta ink cartridge (not shown) through a supply tube and filled with magenta ink. Further, the common ink chamber 43 corresponding to the third nozzle row Nl (3) is communicated with a cyan ink cartridge and filled with cyan ink, and the common ink chamber 43 corresponding to the fourth nozzle row Nl (4) is communicated with a black ink cartridge and filled with black ink.

Meanwhile, the first nozzle row Nl (1) is selectively capable of ejecting yellow ink and white ink. Therefore, the common ink chamber 43 (below, referred to as the "first common ink chamber") corresponding to the first nozzle row Nl (1) may be communicated with a yellow ink cartridge 42 (Y) and a white ink cartridge 42 (W) through a supply tube 46.

In addition, when the ink to be ejected from the first nozzle row Nl (1) is switched, in order that the previously ejected ink does not have an influence thereon, a cleaning solution for cleaning the first common ink chamber 43 and the like may also be supplied to the first common ink chamber 43. In other words, the first common ink chamber 43 may also be communicated with a cleaning solution cartridge (Wa) storing cleaning solution.

In addition, as the cleaning solution, for example, a colorless transparent liquid may be exemplified. In addition, it is preferable to use a liquid including the same components as the components other than the color materials included in the inks. By doing so, even though the cleaning solution remains in the common ink chamber 43 or the like, it is possible to reduce the influence thereof at the time of printing.

In this manner, the first common ink chamber 43 may be communicated with the three cartridges 42 (Y), 42 (W), and 42 (Wa). Therefore, in order that the ink or the cleaning solution from any one of the cartridges 42 among the three cartridges 42 may be supplied to the first common ink chamber 43, a selector valve 45 (selector) is provided on the supply tube 46 between the first common ink chamber 43 and the three cartridges 42.

By adjusting the opening and closing of the selector valve 45, it is also possible to supply yellow ink, white ink, and cleaning solution to the first common ink chamber 43. Thus, the first nozzle row Nl (1) is selectively capable of ejecting yellow ink and white ink (and cleaning solution).

Below, description will be given of the specific method of switching the ink (white ink and yellow ink) ejected from the first nozzle row Nl (1). In addition, a case of switching the ink ejected from the first nozzle row Nl (1) from white ink to yellow ink will be given as an example. In order to switch the color of the ink ejected from the first nozzle row Nl (1), the controller 10 first moves the carriage 31 to the home position (non-printing region) and brings the head 41 to face the waste ink receiving portion (not shown).

Next, the controller 10 adjusts the selector valve 45 and switches the state from a state where the first common ink chamber 43 is communicated with the white ink cartridge 42 (W) to a state where the first common ink chamber 43 is communicated with the cleaning solution cartridge 42 (Wa). Then, the controller 10 forcibly ejects ink from the first nozzle row Nl (1) toward the waste ink receiving portion. At this time, white ink filled in the first common ink chamber 43 or the like is discharged to the waste ink receiving portion and the first common ink chamber 43 is filled with cleaning solution instead.

Here, as a method of forcibly ejecting ink from the first nozzle row Nl (1), for example, there may be exemplified a method of providing a driving signal for ejecting ink to the driving element corresponding to the nozzle Nz belonging to the first nozzle row Nl (1). In addition, a method of forcibly ejecting ink from the first nozzle row Nl (1) by forming a sealed space between the nozzle forming surface of the head 41 and waste ink receiving portion and applying negative pressure to the sealed space with a suction pump or the like may be used.

Then, after time necessary for the first nozzle row Nl (1) to completely discharge the white ink has passed, the controller 10 adjusts the selector valve 45 and switches the state from a state where the first common ink chamber 43 is communicated with the cleaning solution cartridge 42 (Wa) to a state where the first common ink chamber 43 is communicated with the yellow ink cartridge 42 (Y). Then, the liquid filled in the first common ink chamber 43 or the like is switched from the cleaning solution to yellow ink, and, after the time necessary for the ejection of the yellow ink from the first nozzle row Nl (1) to start has passed, the controller 10 stops the ink ejection from the first nozzle row Nl (1).

Thus, the first nozzle row Nl (1) is switched from a state capable of ejecting white ink to a state capable of ejecting yellow ink. In addition, when the ink ejected from the first nozzle row Nl (1) is switched from yellow ink to white ink, adjustment of the selector valve 45 may be performed in reverse.

In addition, when the white ink is left as is for a long time, the color materials of the white ink undergo sedimentation and the density thereof becomes uneven, whereby there is a concern that clogging or the like may occur in the nozzles, for example. Therefore, when the printing is stopped, the first common ink chamber 43 or the like may be filled with cleaning solution or yellow ink instead of white ink.

Print Mode

Figure 4:
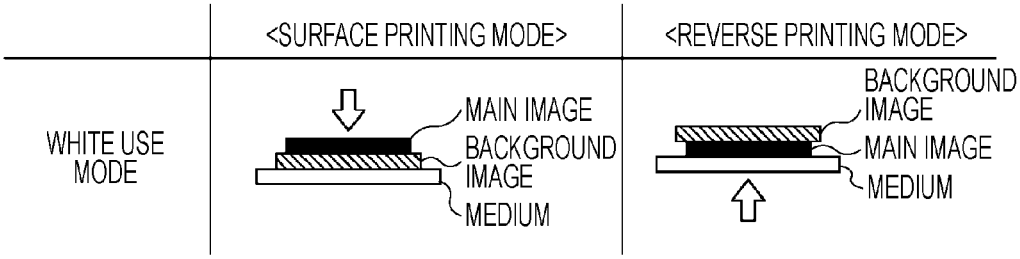
FIG. 4 is a diagram illustrating a print mode provided in the printer.

FIG. 4 is a diagram illustrating a print mode provided in the printer 1. The printer 1 of the embodiment is provided with a "monochrome mode" forming only a monochrome image on the medium using black ink (K), a "color mode" forming only a color image on the medium using four color inks (CMYK), and a "white use mode" forming a background image using white ink (W) superimposed on a main image which is a monochrome image or a color image.

By superimposing the background image on the main image as in the white use mode, for example, it is possible to improve the color of the main image when the medium is not white, or prevent the opposite side of the main image from becoming see-through when the medium is transparent.

Further, in the white use mode, the printer 1 is further provided with a surface printing mode and a reverse printing mode as shown in FIG. 4. The "surface printing mode" is a mode printing the main image so as to be visible from the printing surface side and is a mode forming the background image before the main image with respect to the predetermined region of the medium. On the other hand, the "reverse printing mode" is a mode printing the main image so as to be visible through the medium and is a mode forming the main image before the background image with respect to the predetermined region of the medium.

Printing Method

Printing Method of White Use Mode

Figure 5A:
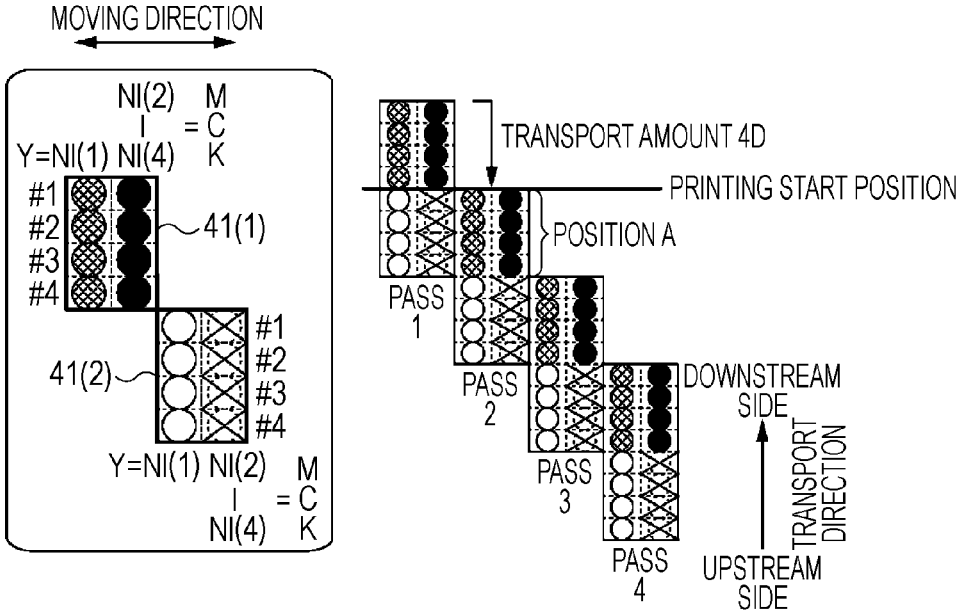
FIG. 5A and FIG. 5B are diagrams illustrating the printing method of a white use mode.
Figure 5B:
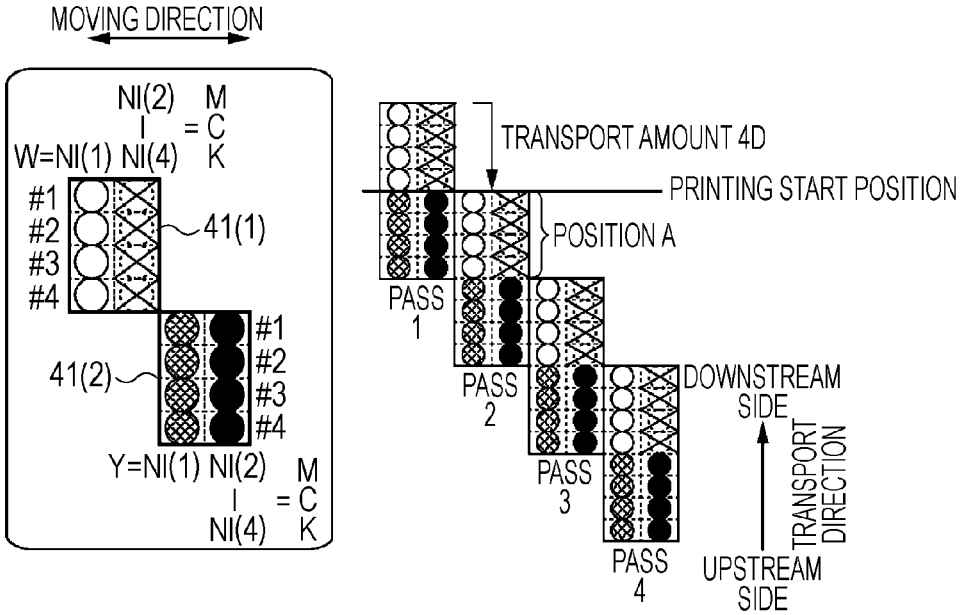

FIG. 5A and FIG. 5B are diagrams illustrating the printing method of the white use mode. In addition, in the drawings, for convenience of explanation, the number of nozzles belonging to one nozzle row is reduced to four (#1 to #4), and the second nozzle row Nl (2) to the fourth nozzle row Nl (4) (nozzle rows ejecting inks of three colors of CMK) are brought together and shown as a single nozzle row. In addition, in practice, the medium is transported to the transport direction downstream side with respect to the head 41; however, in FIGS. 5A and 5B, in order to show the relative positional relationship of the head 41 of each pass, the head 41 is shown shifted to the transport direction upstream side.

In addition, here, band printing may be exemplified. Band printing is a printing method in which band images formed in a single pass are lined up in the transport direction and is a printing method in which raster lines of another pass are not printed between raster lines (dot rows along the moving direction) printed by a certain pass. However, without being limited to band printing, for example, interlace printing (printing method printing raster lines with another pass between raster lines printed by a certain pass) may be employed or overlap printing (printing method printing one raster line with a plurality of nozzles of different passes) may be employed.

FIG. 5A is a diagram illustrating the printing method of the "surface printing mode" forming the main image on the background image. In the surface printing mode, as shown in the left diagram of FIG. 5A, the first nozzle row Nl (1) to the fourth nozzle row Nl (4) of the first head 41 (1) of the transport direction downstream side are set as "nozzle rows for the main image" for forming the main image. Here, in order that yellow ink is ejected from the first nozzle row Nl (1), a state where yellow ink is filled in the first common ink chamber 43 (common ink chamber 43 corresponding to the first nozzle row Nl (1)) is set.

On the other hand, the first nozzle row Nl (1) of the second head 41 (1) of the transport direction upstream side is set as a "nozzle row for the background image" for forming the background image and the second nozzle row Nl (2) to the fourth nozzle row Nl (4) are set as "unused nozzle rows". Here, in order that white ink is ejected from the first nozzle row Nl (1), a state where white ink is filled in the first common ink chamber 43 is set.

In band printing, since the length of the transport direction of one image printed by a single pass corresponds to the transport amount of the medium, the transport amount of medium becomes 4D here. Then, by repeating the ejection operation printing the image with the above-described nozzle setting and the transport operation transporting the medium to the transport direction downstream side by a transport amount 4D, printing is performed as in the right diagram of FIG. 5A.

For example, the medium part for which the position of the transport direction is the position A in the drawing faces the nozzle rows for the background image (W of the second head 41 (2)) in pass 1 and the background image is formed at the medium part of position A. Thereafter, the medium part of position A faces the nozzle rows for the main image (CMYK of the first head 41 (1)) in the next pass 2 and the main image is formed to be superimposed on the background image of the medium part of position A.

FIG. 5B is a diagram illustrating the printing method of the "reverse printing mode" forming the background image on the main image. In the reverse printing mode, as shown in the left diagram of FIG. 5B, the first nozzle row Nl (1) of the first head 41 (1) is set as the "nozzle row for the background image" and the second nozzle row Nl (2) to the fourth nozzle row Nl (4) are set as "unused nozzle rows". Here, in order that white ink is ejected from the first nozzle row Nl (1), a state where white ink is filled in the first common ink chamber 43 is set. On the other hand, the first nozzle row Nl (1) to the fourth nozzle row Nl (4) of the second head 41 (2) are set as "nozzle rows for the main image". Here, in order that yellow ink is ejected from the first nozzle row Nl (1), a state where yellow ink is filled in the first common ink chamber 43 is set.

As a result, printing is performed as shown in the right diagram of FIG. 5B. For example, the medium part for which the position of the transport direction is the position A in the drawing faces the nozzle rows for the main image (CMYK of the second head 41 (2)) in pass 1 and the main image is formed at the medium part of position A. Thereafter, the medium part of position A faces the nozzle rows for the background image (W of the first head 41 (1)) in the next pass 2 and the background image is formed to be superimposed on the main image of the medium part of position A.

In this manner, when the main image and the background image are printed so as to overlap, the second head 41 (2) of the transport direction upstream side prints the image (lower layer image) to be printed first with respect to the predetermined region of the medium and the first head 41 (1) of the transport direction downstream side prints the image (upper layer image) to be printed second with respect to the predetermined region of the medium. By doing so, since the predetermined region of the medium faces the second head 41 (2) printing the lower layer image in the first pass before the first head 41 (1) printing the upper layer image, it is possible to perform printing so as to superimpose the upper layer image on the lower layer image. In other words, depending on the mode, it is possible to overlap and print the main image and the background image with different passes.

Print Flow

FIG. 6 is a flow illustrating the printing flow. As described above, as printing modes, the printer 1 of the embodiment is provided with a "monochrome mode" printing only a monochrome image, a "color mode" printing only a color image, and a "white use mode (surface printing mode and reverse printing mode)" superimposing a background image on a main image.

Therefore, upon receiving a print command and print data from the computer 70, the controller 10 of the printer 1 determines whether or not an image should be printed according to the kind of print mode. For example, the controller 10 may be set to determine the print mode from the print mode information set by the user and the print mode information determined by the printer driver based on the print data, and the controller 10 itself may be set to determine the print mode based on the print data. Here, according to the print mode, the controller 10 controls the printing.

To give a specific description, as shown in FIG. 6, the controller 10 first determines whether or not the print mode is the "white use mode" (S01) and, when the print mode is not the white use mode (N in S01), then determines whether or not the print mode is the "color mode" (S02).

In the printer 1 of this embodiment, as shown in FIG. 2, the fourth nozzle row Nl (4) of the first head 41 (1) and the fourth nozzle row Nl (4) of the second head 41 (2) are always in a state capable of ejecting black ink. Accordingly, when the controller 10 determines that the print mode is not the color mode (N in S02), that is, when the print mode is determined to be the "monochrome mode", a black image is printed on the medium (S03) using the black nozzle row (Nl (4)) of the first head 41 (1) and the black nozzle row (Nl (4)) of the second head 41 (2).

Compared to the case of printing an image using only one head 41, printing an image using two heads 41 (1) and 41 (2) makes it possible to reduce the printing time. Therefore, when the print mode is the monochrome mode, the image is printed in the "high-speed monochrome mode".

Meanwhile, each first nozzle row Nl (1) of the first head 41 (1) and the second head 41 (2) is selectively capable of ejecting white ink and yellow ink. In other words, the yellow ink is not necessarily always ejected from the two heads 41 (1) and 41 (2). In addition, the white ink is used only in the white use mode in which, as shown in FIGS. 5A and 5B, white ink is ejected from only one head 41 of either of the first head 41 (1) or the second head 41 (2). In other words, the white ink is not filled in the two heads (1) and 41 (2) at the same time. That is, if one of the first nozzle rows Nl1 (1) of the head 41 is in a state capable of ejecting white ink, the other of the first nozzle rows Nl (1) of the head 41 is in a state capable of ejecting yellow ink.

Therefore, when the print mode is determined as the "color mode" (Y in S02), the controller 10 determines whether or not the first nozzle row Nl (1) of one of either of the first head 41 (1) and the second head 41 (2) is in a state capable of ejecting white ink (S04). In other words, the controller 10 determines whether or not white ink is filled in either of the first head 41 (1) or the second head 41 (2) (in more detail, determines whether or not white ink is filled in the common ink chamber 43 communicated with the plurality of nozzles belonging to the first nozzle row Nl (1) of one of either of the two heads 41 (1) and 41 (2)).

Since each first nozzle row Nl (1) of the first head 41 (1) and the second head 41 (2) is in a state capable of ejecting yellow ink together when the white ink is not filled in any of the heads 41 (N in S04), the controller 10 uses the four color nozzle row (CMYK) of the first head 41 (1) and the four color nozzle row (CMYK) of the second head 41 (2) to print a color image on the medium. That is, the color image is printed in a "high-speed color mode" (S05).

When the white ink is filled in either of the heads 41 among the two heads 41 (1) and 41 (2) (Y in S04), the controller 10 uses only the four color nozzle row (CMYK) of the other head 41 capable of ejecting yellow ink to print a color image on the medium. That is, the color image is printed in a "normal speed color mode" (S06).

In addition, when it is determined that the print mode is the "white use mode" (Y in S01), the controller 10 then determines whether or not the print mode is the "surface printing mode" (S07). In the surface printing mode (Y in S07), as shown in FIG. 5A, the printer 1 of the embodiment prints a background image using the second head 41 (2) of the transport direction upstream side and prints a main image using the first head 41 (1) of the transport direction downstream side.

Therefore, the controller 10 determines whether or not the first nozzle row Nl (1) of the first head 41 (1) is in a state capable of ejecting yellow ink, that is, whether or not yellow ink is filled in the first head 41 (1) (S08). When the yellow ink is not filled in the first head 41 (1) (N in S08), the controller 10 sets yellow ink to be ejected from the first nozzle row Nl (1) of the first head 41 (1) based on the above-described switching method (S09).

Next, the controller 10 determines whether or not the first nozzle row Nl (1) of the second head 41 (2) is in a state capable of ejecting white ink, that is, whether or not white ink is filled in the second head 41 (2) (S10). When the white ink is not filled in the second head 41 (2) (N in S10), the controller 10 sets white ink to be ejected from the first nozzle row Nl (1) of the second head 41 (2) (S11). Then, as shown in FIG. 5A, the controller 10 uses the four color nozzle rows (CMYK) of the first head 41 (1) and the white nozzle row (W) of the second head 41 (2) and prints the main image so as to be superimposed on the background image (S12).

Meanwhile, in the reverse printing mode (N in S07), as shown in FIG. 5B, the printer 1 of the embodiment prints a main image using the second head 41 (2) of the transport direction upstream side and prints a background image using the first head 41 (1) of the transport direction downstream side. Therefore, when the controller 10 determines whether or not the white ink is filled in the first head 41 (1) (S13), and white ink is not filled therein (N in S13), white ink is set to be ejected from the first nozzle row Nl (1) of the first head 41 (1) (S14).

In addition, when the controller 10 determines whether or not the yellow ink is filled in the second head 41 (2) (S15), and yellow ink is not filled therein (N in S15), yellow ink is set to be ejected from the first nozzle row Nl (1) of the second head 41 (2) (S16). Then, as shown in FIG. 5B, the controller 10 uses the white nozzle row (W) of the first head 41 (1) and the four color nozzle rows (CMYK) of the second head 41 (2) and prints the background image so as to be superimposed on the main image (S17).

Conclusion

In the printer 1 of this embodiment, the first nozzle row Nl (1) of the first head 41 (1) and the first nozzle row Nl (1) of the second head 41 (2) are selectively capable of ejecting yellow ink and white ink.

Here, when the print mode is the "white use and surface printing mode (corresponding to the first mode)" in which the background image is formed before the main image with respect to the predetermined region of the medium, the printer 1 fills yellow ink (ink for forming a main image) in the common ink chamber 43 to which the plurality of nozzles belonging to the first nozzle row Nl (1) (corresponding to the first nozzle row) in the first head 41 (1) (corresponding to the one nozzle row group) is communicated, fills white ink (ink for forming a background image) in the common ink chamber 43 to which the plurality of nozzles belonging to the first nozzle row Nl (1) (corresponding to the second nozzle row) in the second head 41 (2) (corresponding to the other nozzle row group) is communicated, and uses the two heads 41 (1) and 41 (2) to print an image.

On the other hand, when the print mode is the "white use and reverse printing mode (corresponding to the second mode)" in which the main image is formed before the background image with respect to the predetermined region of the medium, the printer 1 fills white ink in the common ink chamber 43 to which the plurality of nozzles belonging to the first nozzle row Nl (1) in the first head 41 (1) is communicated, fills yellow ink in the common ink chamber 43 to which the plurality of nozzles belonging to the first nozzle row Nl (1) in the second head 41 (2) is communicated, and uses the two heads 41 (1) and 41 (2) to print an image.

In other words, in the printer 1 of the embodiment, it is possible to switch the type of ink ejected from each first nozzle row Nl (1) of the first head 41 (1) and the second head 41 (2) according to the print mode, whereby each first nozzle row Nl (1) of the first head 41 (1) and the second head 41 (2) fulfils the roles of both a nozzle row for printing the main image and a nozzle row for printing the background image.

In this manner, compared to a printer in which a nozzle row (W) for printing a background image is provided separately in addition to the nozzle row (CMYK) for printing the main image, the printer 1 of the embodiment may reduce the number of nozzle rows provided in the printer 1.

By reducing the number of nozzle rows, for example, the apparatus may be miniaturized. In addition, it is possible to use the head (for example, a head having four nozzle rows (CMYK) for printing a main image) used in a printer in which a main image and a background image are not overlapped even in the printer 1 of the embodiment. That is, the head may be used in common (used as a general use head) and a reduction in costs achieved.

In addition, in the printer 1 of the embodiment, the first head 41 (1) and the second head 41 (2) are respectively capable of ejecting ink of the same color of a plurality of colors as the inks forming the main image (here, the two heads 41 are set to be capable of ejecting yellow, magenta, cyan and black). Here, the first nozzle row Nl (1) of the first head 41 (1) and the first nozzle row Nl (1) of the second head 41 (2) are set to the same color of the ink to be ejected in order to form the main image (here, set to yellow).

In this manner, with the head 41 in a state where white ink is ejected from the first nozzle row Nl (1) and the head 41 in a state where yellow ink is ejected from the first nozzle row Nl (1), the colors (here, magenta, cyan, and black) of the ink ejected from the nozzle rows other than the first nozzle row Nl (1) may be set to be the same. Since these color inks may always be ejected from the two heads 41 (1) and 41 (2), it is always possible to rapidly perform printing of the image of these colors using the two heads 41 (1) and 41 (2).

In other words, an image of colors other than the color of the ink to be ejected from the first nozzle row Nl (1) may be printed at high speed regardless of whether or not white ink is filled therein. Thus, by making the colors of the ink ejected from each of the first nozzle rows Nl (1) of the two heads 41 (1) and 41 (2), it is possible to increase the colors of the image which may be printed at high speed.

Here, without being limited to making the colors (CMYK) of the inks to be ejected by the first head 41 (1) and the second head 41 (2) in order to form the main image all the same, the first head 41 (1) and the second head 41 (2) may be set to partially eject ink of different colors.

In addition, the first nozzle row Nl (1) of the first head 41 (1) and the first nozzle row Nl (1) of the second head 41 (2) set the color of the ink to be ejected in order to form the main image to a color other than black (here, yellow). Then, when the print mode is the "monochrome mode (corresponding to the third mode)" forming a monochrome image on the medium without forming the background image, the nozzle row ejecting black ink in the first head 41 (1) and the nozzle row ejecting black ink in the second head 41 (2) are used to print an image.

In this manner, it is possible to print a monochrome image at high speed regardless of whether or not white ink is filled in any one of the two heads 41 (1) and 41 (2). Therefore, such a printing method is an effective printing method for a user for whom the frequency of executing the monochrome mode is greater than the frequency of executing the color mode.

In addition, when the print mode is the "color mode (corresponding to the fourth mode)" forming a color image on the medium without forming the background image, and when white ink is not filled in both the common ink chambers 43 to which the first nozzle row Nl (1) of the first head 41 (1) and the first nozzle row Nl (1) of the second head 41 (2) respectively correspond, the first head 41 (1) and the second head 41 (2) are used to print an image on the medium.

In addition, when white ink is filled in one of the common ink chambers 43 to which the first nozzle row Nl (1) of the first head 41 (1) and the first nozzle row Nl (1) of the second head 41 (2) respectively correspond, the first head 41 having the first nozzle row Nl (1) for which the common ink chamber 43 is filled with yellow ink is used to print an image on the medium.

In order to print a color image using the two heads 41 (1) and 41 (2), when a process of switching the ink to be ejected from the first nozzle row Nl (1) from white ink to yellow ink is performed, the ink is consumed for a purpose other than printing and, furthermore, a predetermined time is required for the switching process of the ink, whereby the printing start time is undesirably delayed.

Therefore, in the printer 1 of the embodiment, when the two heads 41 (1) and 41 (2) are together in a state capable of ejecting yellow ink (all inks for forming the color image), the two heads 41 (1) and 41 (2) are used to print an image. By doing so, it is possible to print a color image at high speed. Conversely, when only one head 41 is in a state capable of ejecting yellow ink, only this head 41 is used to print the image. By doing so, it is possible to suppress the consumption of ink for purposes other than printing and to prevent the printing start time being delayed.

MODIFICATION EXAMPLES

Modification Example 1

In the above-described embodiments, the first nozzle row Nl (1) is set to selectively eject yellow ink and white ink from among the colors other than black (CMY); however, without being limited thereto, for example, the first nozzle row Nl (1) may be set to selectively eject magenta ink and white ink or the first nozzle row Nl (1) may be set to selectively eject cyan ink and white ink. Even in these cases, it is possible to rapidly print a monochrome image using the two heads 41 (1) and 41 (2).

Modification Example 2

In the embodiments above, each first nozzle row Nl (1) of the first head 41 (1) and the second head 41 (2) is set to yellow as the same color of the ink to be ejected in order to form the main image; however, the invention is not limited thereto. In order to form the main image, the color of the ink ejected by the first nozzle row Nl (1) of the first head 41 (1) and the color of the ink ejected by the first nozzle row Nl (1) of the second head 41 (2) may be made to be different.

Modification Example 3

In the above-described embodiments, the printer 1 is set to eject five colors of ink (white, yellow, magenta, cyan, and black); however, the invention is not limited thereto. In addition to the above-mentioned inks of five colors (WCMYK), the printer 1 ejecting light inks of two colors (light cyan and light magenta) may be used, in which case, the first nozzle row Nl (1) may be set to selectively eject light ink and white ink.

In addition to the above-mentioned inks of five colors (WCMYK), the printer 1 ejecting clear ink (for example, colorless transparent ink for coating the image) may be used, in which case, the first nozzle row Nl (1) may be set to selectively eject clear ink and white ink.

By doing so, it is possible to rapidly perform printing of a color image using four color inks (CMYK) using the two heads 41 (1) and 41 (2).

Modification Example 4

In the above-described embodiments, the first nozzle row Nl (1) is set to selectively eject ink other than black ink and white ink; however, without being limited thereto, the first nozzle row Nl (1) may be set to selectively eject black ink and white ink. In this case, it is always possible to print a color image at high speed using three color inks (CMY) regardless of whether or not white ink is filled in the heads 41 (1) and 41 (2).

However, when white ink is filled in any one of the two heads 41 (1) and 41 (2), only the head 41 filled with black ink is used, and a monochrome image is printed at normal speed. Alternatively, after switching the ink to be ejected by the first nozzle row Nl (1) of the head 41 filled with white ink, a monochrome image is printed at high speed. Therefore, this is an effective printing method for a user for whom the frequency of executing the color mode is greater than the frequency of executing the monochrome mode.

In addition, when white ink is filled in one of the two heads 41 (1) and 41 (2) in a case where the first nozzle row Nl (1) is selectively set to eject black ink and white ink, each of the three color nozzle rows (CMY) of the first head 41 (1) and the second head 41 (2) may be used and set to print a composite black image. By doing so, it is possible to print a (composite black) monochrome image at high speed without switching the ink ejected from the first nozzle row Nl (1) from white to black. However, with a monochrome image using black ink and monochrome image using composite black, the shades become different, which is not desirable.

Modification Example 5

In the above-described embodiments, when white ink is filled in any one of the two heads 41 (1) and 41 (2) (Y in S04 of FIG. 6), only the head 41 not filled with white ink is used, and a color image is printed at normal speed; however, the invention is not limited thereto. For example, the ink to be ejected by the first nozzle row Nl (1) of the head 41 filled with white ink may be switched, and a color image may always be set to be printed at high speed using the two heads 41 (1) and 41 (2).

However, when the ink to be ejected by the first nozzle row Nl (1) of the head 41 filled with white ink is switched, the ink is consumed for a purpose other than printing and the printing start time is undesirably delayed. Therefore, when the number of pages of the color image to be printed is a threshold value or higher, the ink to be ejected by the first nozzle row Nl (1) of the head 41 filled with white ink is switched, and a color image is set to be printed at high speed using the two heads 41 (1) and 41 (2). When the number of pages of the color image to be printed is lower than the threshold value, a color image is set to be printed at normal speed using only the head 41 filled with yellow ink.

In other words, in a case where printing a color image at high speed using the two heads 41 (1) and 41 (2) makes it possible to shorten the overall printing time in comparison with a case of printing a color image using one head 41 even when the switching process of the ink is performed, the ink switching process is set to be performed. By doing so, it is possible to suppress the consumption of ink for purposes other than printing while shortening the printing time of the color image.

Modification Example 6

In the above-described embodiments, when printing is possible using the two heads 41 (1) and 41 (2) (for example, the case of the monochrome mode), an image is printed at high speed using the two heads 41 (1) and 41 (2); however, without being limited thereto, it is possible to set only one of any of the heads 41 so as to be used in the monochrome mode and color mode in which a background image is not printed.

Further, in such a case, the first head 41 (1) and the second head 41 (2) are separated in the transport direction, and it is possible to provide a non-ejection region in which ink is not ejected between the transport directions of the first head 41 (1) and the second head 41 (2). By doing so, in the white use mode, after the lower layer image is printed by the second head 41 (2) with respect to the predetermined region of the medium, it is possible to make the lower layer image on the predetermined region of the medium face the non-ejection region. Therefore, while facing the non-ejection region, it is possible to sufficiently cure the lower layer image using the ultraviolet light from the provisional irradiation units 51*a* and 51*b*. Thus, it is possible to superimpose an upper layer image in a state where the lower layer image is sufficiently cured and it is possible to suppress image quality deterioration.

Moreover, even in a case where UV ink is not used, by lengthening the time from the printing of the lower layer image to the superimposing and printing of the upper layer image, it is possible to superimpose the upper layer image in a state where the lower layer image is sufficiently dried and it is possible to suppress image quality deterioration.

Modification Example 7

In the above-described embodiment (FIG. 3), the first nozzle row N1 (1) is set to be selectively capable of ejecting yellow ink and white ink according to the selector valve 45; however, the invention is not limited thereto. For example, it may be set such that, when the ink is switched, the inside of the head 41 is cleaned and each ink cartridge is replaced. In addition, the first nozzle row Nl (1) may not be communicated with the cleaning solution cartridge 42 (Wa).

Modification Example 8

In the above-described embodiment, the background image is printed only with white ink; however, the invention is not limited thereto. Since the shade of the white differs slightly according to the type of the white ink, when printing is performed using only white ink, the color of the white ink itself becomes the color of the background image. Further, a background image having a slight chromatic color instead of simple white may be desired. Therefore, it is also possible to print the desired white background image (adjusted white background image) by appropriately using white ink and small amounts of color inks (three colors of CMYK). In addition, in contrast, by mixing the four colored inks with the white ink, it may be possible to counteract the slight chroma of the white ink. In such a case, for example, in the print method of FIG. 5A, the second nozzle row Nl (2) to the fourth nozzle row Nl (4) of the second print head 41 (2) become nozzle rows adjusting the shade of the background image.

Further, the background image is not limited to being white and the background image may be printed using color ink other than white ink (for example, metallic inks).

Other Embodiments

The above-described embodiments have been described mainly with regard to an image forming apparatus; however, the disclosure of an image forming method and the like is also included. In addition, the above-described embodiments are intended to facilitate understanding of the invention and should not be interpreted as limiting the invention. It is needless to say that the invention may be modified and improved within a range not exceeding the gist of the invention and furthermore, that the invention also includes equivalents thereto.

Ink

In the embodiments above, ultraviolet curable ink (UV ink) was given as an example of a photocurable ink; however, without being limited thereto, for example, ink cured by being irradiated with visible light may be used. In addition, without being limited to photocurable ink, for example, a water-based ink or an organic solvent based ink penetrating the medium may be used.

Printer

In the above-described embodiments, an example has been given of a printer repeating the ejection operation ejecting ink from the head moving in the moving direction and the transport operation transporting the medium in the transport direction; however, the invention is not limited thereto. For example, the printer may be a printer in which, with respect to continuous paper transported in the print region, an operation of forming an image while the head is moved in the medium transport direction and an operation of moving the head in the paper width direction are repeated to form an image, after which the medium portion which is not yet printed is transported to the print region.

White

In the specification, "white" is not limited to white in the strict sense of a surface color of an object reflecting 100% of all visible light wavelengths but, as commonly accepted, includes colors referred to as white such as so-called "whitish colors". "White", for example, may mean: (1) when colorimetry is performed with Colorimetry mode using a colorimeter Eye-One Pro manufactured by X-Rite: spot colorimetry, Light source: D50, Backing: black, and Print medium: transparent film, a color for which the heading of the Lab system is the circumference of a radius 20 on an a*b* flat surface and the inside thereof and for which L* is within a color phase range expressed by 70 or more, (2) when colorimetry is performed with a field of vision of a measurement mode D502° using a colorimeter CM2022 manufactured by Minolta, an SCF mode, and a white background, a color for which the heading of the Lab system is the circumference of a radius 20 on an a*b* flat surface and the inside thereof and for which L* is within a color phase range expressed by 70 or more, and (3) a color of an ink used as the background of an image as disclosed in JP-A-2004-306591, and as long as the white may be used as a background, the white is not limited to being a pure white.

What is claimed is:

1. An image forming apparatus comprising:

a plurality of nozzle row groups including a first nozzle row group and a second nozzle row group, wherein:

the first nozzle row group is positioned shifted to one side in a predetermined direction with respect to the second nozzle row group, each nozzle row group includes a plurality of nozzle rows extending in an intersecting direction that intersects the predetermined direction, a plurality of nozzles ejecting ink are lined up in the predetermined direction in each of the nozzle rows, wherein the plurality of nozzles in each of the nozzle rows communicate with a common ink chamber; and a control unit repeatedly performing:

an ejection operation ejecting the ink from the nozzles while relatively moving the plurality of nozzle row groups and a medium in the intersecting direction, and a transport operation moving a relative position of the medium with respect to the plurality of nozzle row groups to one side in the predetermined direction, wherein the image forming apparatus is provided with:

a first mode, in which:

ink forming a main image is filled into the common ink chamber communicating with the plurality of nozzles belonging to a first nozzle row in the first nozzle row group, ink forming a background image of the main image is filled into the common ink chamber communicating with the plurality of nozzles belonging to a second nozzle row in the second nozzle row group, and the first nozzle row group and the second nozzle row group are used to form the background image before the main image with respect to a predetermined region of the medium, and a second mode, in which:

ink forming the background image is filled into the common ink chamber communicating with the plurality of nozzles belonging to the first nozzle row, ink forming the main image is filled into the common ink chamber communicating with the plurality of nozzles belonging to the second nozzle row, and the first nozzle row group and the second nozzle row group are used to form the main image before the background image with respect to a predetermined region of the medium.

2. The image forming apparatus according to claim 1, wherein the first nozzle row group and the second nozzle row group are respectively capable of ejecting same color inks of a plurality of colors as the ink forming the main image, and the color of the ink forming the main image ejected from the first nozzle row and the color of the ink forming the main image ejected from the second nozzle row are the same.

3. The image forming apparatus according to claim 2, further provided with a third mode, wherein the color of the ink forming the main image respectively ejected from the first nozzle row and the second nozzle row is a color other than black, and the nozzle row ejecting black ink in the first nozzle row group and the nozzle row ejecting black ink in the second nozzle row group are used to form the main image, which is a monochrome image, on the medium without forming the background image.

4. The image forming apparatus according to claim 3, further provided with a fourth mode, wherein when ink forming the background image is not filled in both of the common ink chamber communicated with the plurality of nozzles belonging to the first nozzle row and the common ink chamber communicated with the plurality of nozzles belonging to the second nozzle row, the first nozzle row group and the second nozzle row group are used, and, when the ink forming the background image is filled in one of the common ink chamber communicated with the plurality of nozzles belonging to the first nozzle row and the common ink chamber communicated with the plurality of nozzles belonging to the second nozzle row, the nozzle row group having the nozzle row for which the common ink chamber is filled with the ink forming the main image among the first nozzle row and the second nozzle row is used, whereby the main image, which is a color image, is formed on the medium without forming the background image.

5. The image forming apparatus according to claim 4, wherein when the ink forming the background image is filled in one of the common ink chamber communicated with the plurality of nozzles belonging to the first nozzle row and the common ink chamber communicated with the plurality of nozzles belonging to the second nozzle row and a volume of the color image to be formed is a threshold value or higher in the fourth mode, the color image is formed using the first nozzle row group and the second nozzle row group after the ink in the nozzle row group having the nozzle row for which the common ink chamber is filled with the ink forming the background image is switched to the ink forming the color image.

6. An image forming method provided with an image forming apparatus including a plurality of nozzle row groups in which:

a first nozzle row group is positioned shifted to one side in a predetermined direction with respect to a second nozzle row group, a plurality of nozzle rows extending in a direction intersecting the predetermined direction in each of the nozzle row groups, a plurality of nozzles ejecting ink are lined up in the predetermined direction in each of the nozzle rows, and the plurality of nozzles communicate with a common ink chamber, and a control unit repeatedly performing an ejection operation ejecting the ink from the nozzles while relatively moving the plurality of nozzle row groups and the medium in intersecting directions and a transport operation moving a relative position of the medium with respect to the plurality of nozzle row groups to one side in the predetermined direction, the method comprising:

when the background image is formed before the main image with respect to a predetermined region of the medium, ink forming the main image being filled into the common ink chamber communicating with the plurality of nozzles belonging to a first nozzle row in the first nozzle row group, ink forming a background image of the main image being filled into the common ink chamber communicating with the plurality of nozzles belonging to a second nozzle row in the second nozzle row group, and the first nozzle row group and the second nozzle row group being used to form an image on the medium, and when the main image is formed before the background image with respect to a predetermined region of the medium, ink forming the background image being filled into the common ink chamber communicating with the plurality of nozzles belonging to the first nozzle row, ink forming the main image being filled into the common ink chamber communicating with the plurality of nozzles belonging to the second nozzle row, and the first nozzle row group and the second nozzle row group being used to form an image on the medium.

* * * * *